US006192795B1

(12) United States Patent
D'Alessandro

(10) Patent No.: US 6,192,795 B1
(45) **Date of Patent: *Feb. 27, 2001**

(54) SCREEN PRINTING APPARATUS WITH INDEPENDENT SCREEN ADJUSTMENT

(75) Inventor: Chris T. D'Alessandro, Saddle Brook, NJ (US)

(73) Assignee: Hix Corporation, Pittsburgh, KS (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/931,427

(22) Filed: Sep. 16, 1997

(51) Int. Cl.[7] ..... B41F 15/36

(52) U.S. Cl. ..... 101/127.1; 101/DIG. 36

(58) Field of Search ..... 101/115, 123, 101/126, 127.1, 128.1, 485, 486, DIG. 36

(56) References Cited

U.S. PATENT DOCUMENTS

| | | | | |
|---|---|---|---|---|
| Re. 29,206 | | 5/1977 | Jaffa | 101/407.1 |
| 3,763,776 | | 10/1973 | Jaffa | 101/126 |
| 4,031,825 | | 6/1977 | Jaffa | 101/126 |
| 4,073,232 | * | 2/1978 | Brewer | 101/126 |
| 4,226,181 | * | 10/1980 | Ericsson | 101/DIG. 36 |
| 4,407,195 | | 10/1983 | Jaffa | 101/123 |
| 4,649,815 | * | 3/1987 | Richardson | 101/126 |
| 4,735,139 | | 4/1988 | Szarka | 101/126 |
| 4,846,058 | | 7/1989 | Farris | 101/123 |
| 4,907,505 | * | 3/1990 | Ericsson et al. | 101/DIG. 36 |
| 4,909,146 | | 3/1990 | Szarka | 101/126 |
| 4,920,878 | * | 5/1990 | Harpold et al. | 101/115 |
| 4,938,130 | | 7/1990 | Thorpe | 101/126 |
| 5,239,923 | * | 8/1993 | Belcher et al. | 101/123 |
| 5,245,922 | * | 9/1993 | Klemm | 101/115 |
| 5,355,791 | * | 10/1994 | Benedetto et al. | 101/127.1 |
| 5,456,172 | | 10/1995 | Herrmann | 101/115 |
| 5,483,882 | | 1/1996 | Jaffa | 101/128 |
| 5,582,104 | * | 12/1996 | Best et al. | 101/127.1 |
| 5,607,243 | | 3/1997 | Szarka | 101/126 |

FOREIGN PATENT DOCUMENTS

| | | | | |
|---|---|---|---|---|
| 143144 | * | 6/1986 | (JP) | 101/126 |

OTHER PUBLICATIONS

R. O. I. Series, Precision Screen Machines, Inc. 44 Utter Avenue, Hawthone, NJ, 07506.

* cited by examiner

*Primary Examiner*—Stephen R. Funk
(74) *Attorney, Agent, or Firm*—Shook, Hardy & Bacon L.L.P.

(57) ABSTRACT

In one aspect, the present invention is an apparatus for microregistering a screen within a screen printing device, wherein the screen printing device has at least one pallet and a pallet drive mechanism for indexing the pallet. The apparatus includes a semi-stationary print head assembly which is selectively movable in an x-direction which is parallel to the path of the pallet and selectively lockable at a desired print location, the print head assembly including: a mechanism for registering the screen in a generally horizontal x-y plane, wherein angular displacement of the screen in a theta direction corresponds to rotation about a substantially vertical axis passing through the x-y plane; and, a mechanism for adjusting the orientation of the screen within the x-y plane with either a linear displacement in the y-direction or an angular displacement in the theta-direction, or both. Thus, adjustment of the screen relative to the pallet in the x-direction at the desired index location is accomplished independently of adjustment of the screen in either the y-direction or the theta-direction.

24 Claims, 10 Drawing Sheets

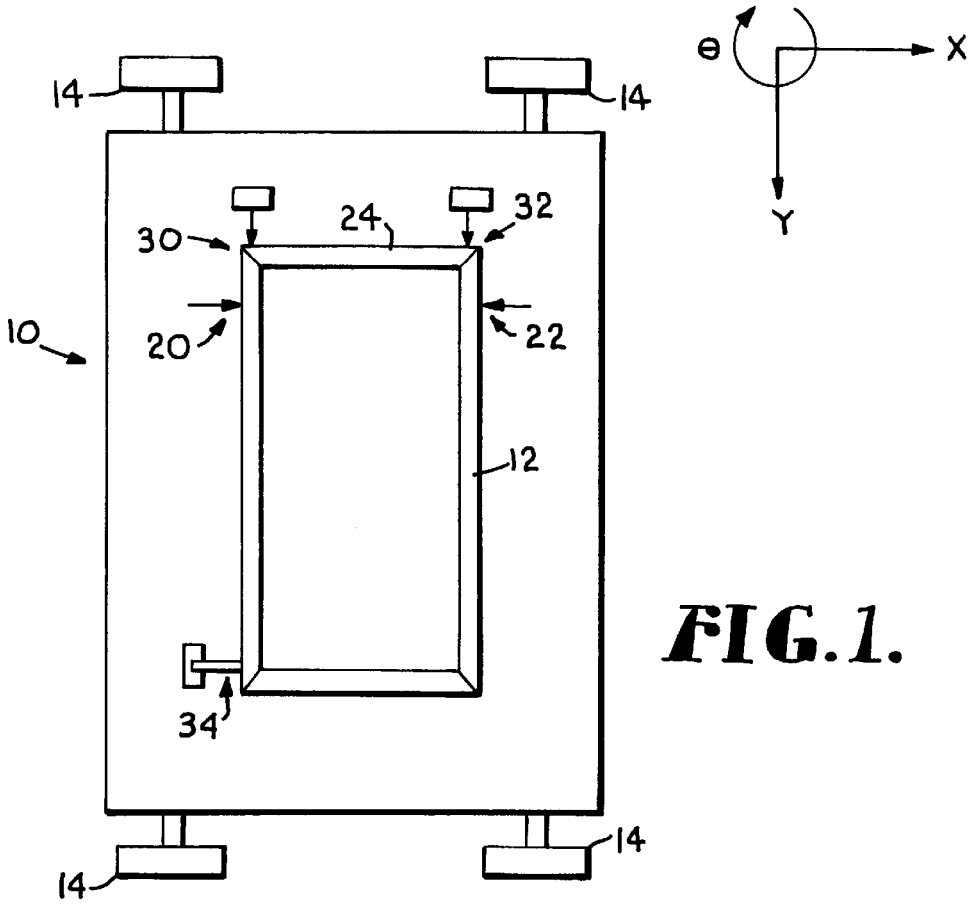
FIG. 1.
FIG. 2.
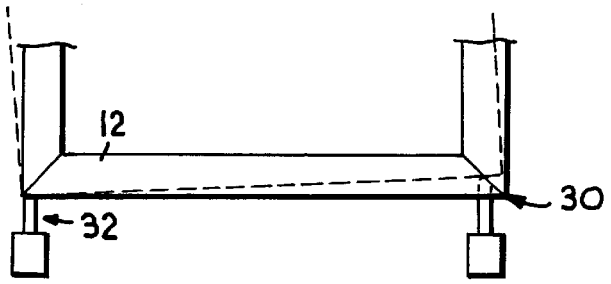
FIG. 3.
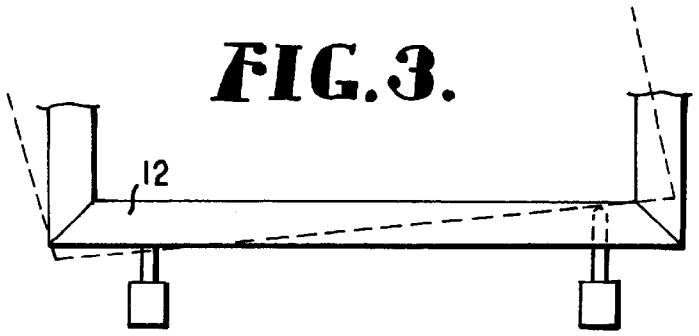

FIG. 10.
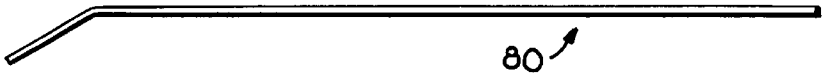
FIG. 11.
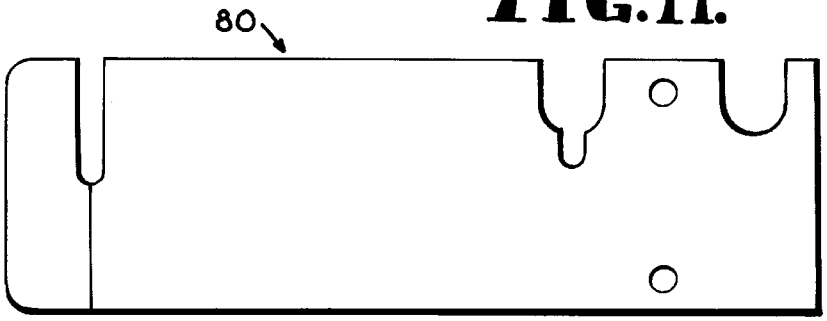
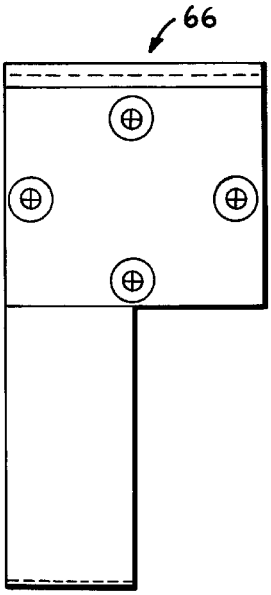
FIG. 12.
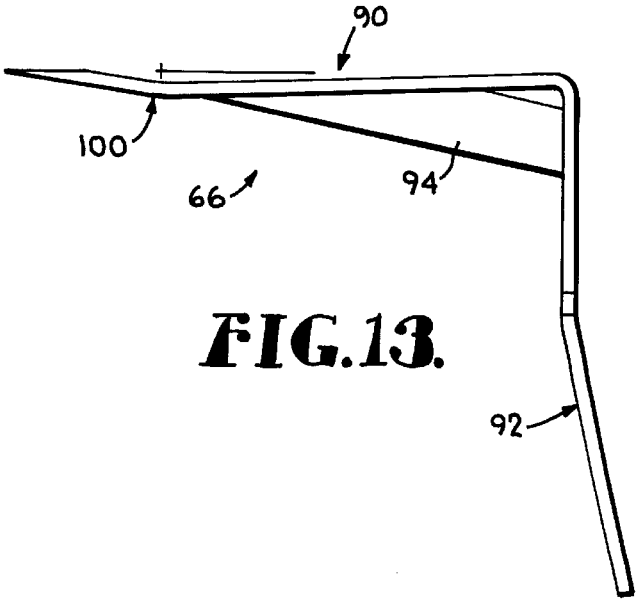
FIG. 13.

SCREEN PRINTING APPARATUS WITH INDEPENDENT SCREEN ADJUSTMENT

FIELD OF THE INVENTION

The present invention relates to printing apparatuses generally and, more particularly, but not by way of limitation, to a novel printing apparatus having independent microregistration means.

BACKGROUND OF THE INVENTION

The present invention concerns printing apparatuses in general, for example, screen printing or graphic arts apparatuses, which may include printing apparatuses of the endless chain drive, rotary, or straight path varieties.

For purposes of illustration, screen printing apparatuses are largely discussed herein, although the present invention is applicable to various other types of printing devices.

The problems associated with proper alignment between a screen registered in a screen printing apparatus and the object to be printed, such as an article of clothing, are well known. These alignment problems become exacerbated over time and increase in complexity with increasing numbers of screens used to effectuate certain designs. For example, multicolor screen printing typically involves a plurality of screens, each screen being provided with a certain design or part of a design which has a particular color associated therewith. Proper registration of each screen is important especially when an object is printed with more than one color or design. Registration may be in the x-direction (e.g. left/right), y-direction (front/back), or theta-direction (rotation about a z-axis perpendicular to the x-y plane).

As generally used herein, registration refers to the placement of individual screens each containing a color which collectively comprise the entire design in a relationship to each other so that when each screen individually transfers its color image to the substrate, the colors making up the design are in an optimum relationship to each other.

With present devices, any registration adjustment to the screen will affect all phases of alignment to various degrees because existing machines generally attempt to correct deficiencies in the position of a screen by trying to correct each of the x, y and theta adjustments at one time. Thus, any adjustment made to correct misregistration affects the entire image and typically results in numerous subsequent adjustments, almost in an iterative manner. For example, an adjustment along the y axis may unintentionally produce a misalignment in the angular orientation of the screen, thereby requiring further adjustment to the theta registration. Conversely, adjustments about the theta axis invariably affect both y and x direction positions simultaneously, thereby requiring further adjustment. Similarly, adjustments to x-registration positions will affect the theta position, which also in turn affects the y position.

OBJECTS OF THE PRESENT INVENTION

Thus, a primary object of the present invention is to provide a printing apparatus having a registration system wherein x-registration adjustments are separated from y- and theta-adjustments.

Another object of the present invention is to provide a registration system for receiving and positioning a screen which can take into account the individual characteristics of the screen for proper adjustment with respect to the printing head.

Furthermore, it is well known that after periods of use, a screen frame will develop irregularities or deformities, some of which may be on the order of magnitude of micrometers or even millimeters. For example, a screen may, after use, take on the shape of a parallelogram rather than its original square or rectangular shape, however slight the change in angle may be. By way of further example, when the screens are transported or cast aside or placed on their ends, the edges or sides of the screen frames may develop pits or burrs or other surface defects which detract from its original smooth, flat surface. Furthermore, screen fabric may lose tension after time and usage. Moreover, a screen may be improperly positioned during exposure, and/or variations may exist in a positive. Thus, the effects of one or more of these aberrations must be corrected for each screen on a printing device.

Thus, substitution of one screen, which was adequately positioned in a printing head , with another screen may result in at least a slight misregistration, even if the two screens appear to the user to be equivalent.

Therefore it is another object of the present invention to provide a registration system which positions a screen within a printing head and adjusts the screen by using fine adjustments, and to allow the removal of a screen and the return to its printing position within the printing head after being serviced, etc., while still remaining within acceptable registration tolerances.

Another object of the present invention is a preregistration system whose registration points coincide with corresponding registration points in each printing head.

Numerous known screen printing apparatuses and subsystems therefor already exist. For example , the following patents, all of which a re incorporated as if fully set out herein, describe various screen printing devices: U.S. Pat. Nos. 4,031,825; 4,407,195; 4,735,139; 4,846,058; 4,909,146; 4,938,130; 5,456,172; 5,483,882; 5,607,243, and U.S. Pat. No. Re.29206.

Other objects of the present invention, as well as particular features, elements, and advantages thereof, w ill be elucidated in, or be apparent from, the following description and the accompanying drawing figures.

SUMMARY OF THE INVENTION

The present invention achieves the above objects among others, by providing a novel printing apparatus.

In one aspect, the present invention comprises a registration means for microregistering a screen which is disposed in a generally horizontal x-y plane within a printing device, the printing device having at least one pallet for mounting an object to be printed. The registration means includes a semi-stationary print head assembly which is selectively movable in an x-direction and which is selectively lockable at a desired print location. The print head assembly includes: screen receiving means for receiving the screen in the x-y plane, wherein angular displacement of the screen in a theta direction corresponds to rotation about a substantially vertical axis passing through the x-y plane; and screen adjustment means for adjusting the orientation of the screen within the x-y plane in at least one of linear displacement in the y-direction and angular displacement in the theta-direction. Thus, adjustment of the screen relative to the pallet in the x-direction at the desired print location is accomplished independently of adjustment of the screen in both the y-direction and the theta-direction. The screen adjustment means preferably allows linear displacement of the screen in the y-direction independently of angular displacement of in the theta-direction.

The printing device may further comprise a pallet drive means for indexing the pallet, in a generally horizontal plane, into and out of proximity with the semi-stationary print head assembly at the desired print location. A pallet drive means may selectively move the pallet in the x-direction. The pallet drive means may index the pallet around a closed loop.

The screen adjustment means most preferably comprises means for engaging the extreme ends of a side of the screen which is parallel to the x-direction, wherein each of the extreme ends of the screen is capable of being selectively moved independently of each other.

In another aspect, the present invention comprises an apparatus for microregistering a screen within a printing device, wherein the printing device has at least one pallet and a pallet drive means for indexing the pallet. The apparatus comprises a semi-stationary print head assembly which is selectively movable in an x-direction which is parallel to the path of the pallet and selectively lockable at a desired print location, the print head assembly including: means for registering the screen in a generally horizontal x-y plane, wherein angular displacement of the screen in a theta direction corresponds to rotation about a substantially vertical axis passing through the x-y plane; and means for adjusting the orientation of the screen within the x-y plane in at least one of linear displacement in the y-direction and angular displacement in the theta-direction.

Thus, adjustment of the screen relative to the pallet in the x-direction at the desired print location is accomplished independently of adjustment of the screen in both the y-direction and the theta-direction.

In a preferred embodiment, the means for microregistering the screen further comprises engaging opposite ends of at least one of the sides of the screen substantially at the comers of the screen.

In another aspect, the present invention comprises a screen printing apparatus for use with at least one framed screen. The apparatus comprises a main frame including a front rail and a rear rail; a pallet drive assembly; and at least one printing head assembly mounted on the main frame. The pallet drive assembly includes at least one pallet and a pallet drive means mounted to the main frame for indexing the pallet, the pallet being indexed in an x-direction while remaining generally in a horizontal orientation.

The printing head assembly is selectively moveable in the x-direction. The printing head assembly includes a carriage, adjustably positionable atop the front and rear rails of the main frame, and y-theta positioning means, mounted to the carriage, for abutting the screen in a generally horizontal x-y plane and for selectively adjusting the orientation of the screen in at least one of a linear displacement in the y-direction and an angular displacement in a theta-direction about a substantially vertical axis passing through the x-y plane.

The pallet drive means indexes the pallet to the printing head assembly at a desired print location. The linear position of the screen relative to the pallet in the x-direction is thus adjustable by moving the carriage relative to the main frame in the x-direction. Changes in both the linear orientation of the screen in the y-direction and the angular orientation of the screen in the theta-direction, relative to the pallet, are effected by moving the screen relative to the carriage. Adjustment of the screen relative to the pallet in the x-direction is thus accomplished independently of adjustment of the screen in both the y-direction and the theta-direction .

The screen printing apparatus may further comprise pallet engaging means for selectively raising the front end of the pallet toward the screen in the printing head assembly during printing.

The y-theta positioning means preferably comprises: frame receiving means fixedly disposed on the carriage for releasably registering the screen therewithin; clamping means for releasably locking the screen with respect to the frame receiving means; and biasing means for urging the screen in to leftward register within the frame receiving means.

The y-theta positioning means further preferably comprises: a left actuator fixedly attached to the left rear of the carriage for selectively moving the left end of the rear cross-bar forward and backward in the y-direction; and, a right actuator fixedly attached to the right rear of the carriage for selectively moving the right end of the rear cross-bar forward and backward in the y-direction. Thus, unequal changes in y-displacement of the left and right ends of the cross-bar result in angular displacement of the screen in the theta direction.

The frame-receiving means may further include guide means for contacting the outer periphery of the screen, whereby the guide means facilitates repeatable registration of the screen. In a particular embodiment, the guide means comprises at least one spring-biased inwardly projecting guide pin and pin locking means for selectively locking the pin.

The screen printing apparatus may further include rear locator means for releasably securing the rear of the pallet at the desired print location.

In another aspect, the present invention relates to a method for microregistering a screen within a screen printing apparatus, the screen printing apparatus including at least one pallet, a semi-stationary print head capable of receiving the screen, and a pallet drive means for indexing the pallet, the pallet being indexed, wherein the screen is disposed in a generally horizontal x-y plane, wherein angular displacement of the screen about a substantially vertical axis passing through the x-y plane corresponds to a theta direction. The method comprises: microadjusting the position of the semi-stationary print head in the x-direction and securing the print head at a desired print location; and microadjusting the screen within the print head in at least one of the y-direction and the theta-direction. Thus, microadjustment of the screen relative to the pallet in the x-direction is accomplished independently of microadjustment of the screen in the y-direction and the theta-direction.

In yet another aspect, the present invention relates to a method for microregistering a screen within a printing apparatus, the printing apparatus including at least one pallet for mounting an object to be printed, a semi-stationary print head capable of receiving the screen in a generally horizontal x-y plane, wherein angular displacement of the screen about a substantially vertical axis passing through the x-y plane corresponds to a theta direction. The method comprises: microadjusting the position of the semi-stationary print head in the x-direction and securing the print head at a desired index location; and microadjusting the screen within the print head in at least one of the y-direction and the theta-direction, whereby microadjustment of the screen relative to the pallet in the x-direction is accomplished independently of microadjustment of the screen in the y-direction and the theta-direction.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which:

FIG. 1 is a schematic illustration of a top plan view of a printing head carriage according to the present invention, movable in the x-direction, which receives and adjusts a screen in the x-y plane, whereby adjustments in the y-direction and theta-direction are accomplished by contacting the screen at various points;

FIG. 2 is a schematic illustration of a partial top plan view of a print head carriage which provides two contact points substantially at the extreme ends of a screen for making microregistration adjustments of the screen;

FIG. 3 is a schematic illustration of a partial top plan view of a print head carriage which provides two contact points which are unacceptably removed from the extreme ends of the screen;

FIG. 10 is a top plan view of the spring member seen in FIG. 6;

FIG. 11 is a front elevational view of the spring member of FIG. 10;

FIG. 12 is a top plan view of the fixed bracket as seen in FIG. 6;

FIG. 13 is a side elevational view of the fixed bracket of FIG. 12;

DETAILED DESCRIPTION OF THE PREFERRED EMBODIMENTS

Figure 4:
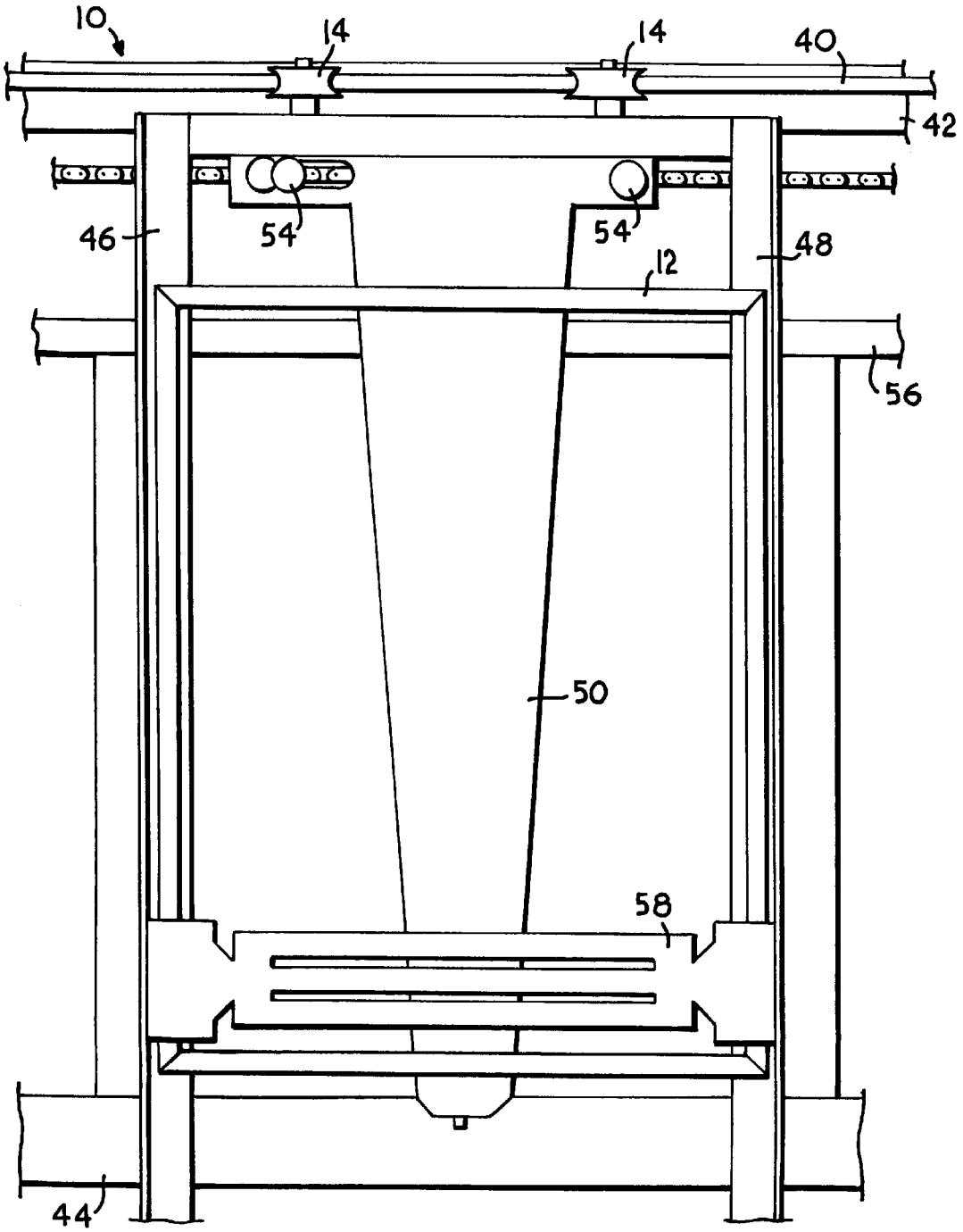
FIG. 4 is a top plan view of a particular embodiment of the present invention showing a printing head carriage movably disposed upon a stationary frame, a pallet attached to an indexing chain, a squeegee/applicator arm movable with respect to the pallet, and a screen mounted on the printing head assembly.

In one aspect, the present invention comprises a registration means for microregistering a screen which is disposed in a generally horizontal x-y plane within a printing device, the printing device having at least one pallet for mounting an object to be printed. The registration means includes a semi-stationary print head assembly which is selectively movable in an x-direction and which is selectively lockable at a desired print location. The print head assembly includes: screen receiving means for receiving the screen in the x-y plane, wherein angular displacement of the screen in a theta direction corresponds to rotation about a substantially vertical axis passing through the x-y plane; and screen adjustment means for adjusting the orientation of the screen within the x-y plane in at least one of linear displacement in the y-direction and angular displacement in the theta-direction. Thus, adjustment of the screen relative to the pallet in the x-direction at the desired print location is accomplished independently of adjustment of the screen in both the y-direction and the theta-direction.

The screen adjustment means preferably allows linear displacement of the screen in the y-direction independently of angular displacement of in the theta-direction.

The printing device may further comprise a pallet drive means for indexing the pallet, in a generally horizontal plane, into and out of proximity with the semi-stationary print head assembly at the desired print location. A pallet drive means may selectively move the pallet in the x-direction. The pallet drive means may index the pallet around a closed loop.

The registration means may further comprise means for moving the pallet and the print head assembly into vertical proximity, which may further comprise means for moving the pallet upward toward the print head assembly, or may further comprise means for moving the print head assembly downward toward the pallet. Alternately, the pallet may comprise a conveyor means for carrying the object into proximity with the printing head assembly.

The screen typically has a generally quadrilateral outline, although screens of different shapes may be used with the present invention.

The screen adjustment means most preferably comprises means for engaging the extreme ends of a side of the screen which is parallel to the x-direction, wherein each of the extreme ends of the screen is capable of being selectively moved independently of each other.

In another aspect, the present invention comprises an apparatus for microregistering a screen within a printing device, wherein the printing device has at least one pallet and a pallet drive means for indexing the pallet. The apparatus comprises a semi-stationary print head assembly which is selectively movable in an x-direction which is parallel to the path of the pallet and selectively lockable at a desired print location, the print head assembly including: means for registering the screen in a generally horizontal x-y plane, wherein angular displacement of the screen in a theta direction corresponds to rotation about a substantially vertical axis passing through the x-y plane; and means for adjusting the orientation of the screen within the x-y plane in at least one of linear displacement in the y-direction and angular displacement in the theta-direction. Thus, adjustment of the screen relative to the pallet in the x-direction at the desired print location is accomplished independently of adjustment of the screen in both the y-direction and the theta-direction.

In a particular embodiment, the screen may have a quadrilateral perimeter having four sides and four corners, wherein the means for microregistering the screen further comprises engaging opposite ends of at least one of the sides substantially at one of the corners.

The print head assembly preferably remains at a desired elevation during printing. The elevation of the print head is preferably adjustable.

The apparatus further preferably comprises means for raising at least a portion of the pallet toward the print head assembly when the pallet is disposed at the desired print location, thereby placing the pallet into proximity with the screen during printing.

In another aspect, the present invention comprises a screen printing apparatus for use with at least one framed screen. The apparatus comprises a main frame including a front rail and a rear rail; a pallet drive assembly; and at least one printing head assembly mounted on the main frame. The pallet drive assembly includes at least one pallet and a pallet drive means mounted to the main frame for indexing the pallet, the pallet being indexed in an x-direction while remaining generally in a horizontal orientation.

The printing head assembly is selectively moveable in the x-direction. The printing head assembly includes a carriage, adjustably positionable atop the front and rear rails of the main frame, and y-theta positioning means, mounted to the carriage, for abutting the screen in a generally horizontal x-y plane and for selectively adjusting the orientation of the screen in at least one of a linear displacement in the y-direction and an angular displacement in a theta-direction about a substantially vertical axis passing through the x-y plane.

The pallet drive means indexes the pallet to the printing head assembly at a desired print location. The linear position of the screen relative to the pallet in the x-direction is thus adjustable by moving the carriage relative to the main frame in the x-direction. Changes in both the linear orientation of the screen in the y-direction and the angular orientation of the screen in the theta-direction, relative to the pallet, are effected by moving the screen relative to the carriage. Adjustment of the screen relative to the pallet in the x-direction is thus accomplished independently of adjustment of the screen in both the y-direction and the theta-direction.

In a particular embodiment, the pallet drive means may be a chain drive, and the chain drive may comprise an endless chain.

The screen printing apparatus may further comprise pallet engaging means for selectively raising the front end of the pallet toward the screen in the printing head assembly during printing. The pallet engaging means may include a vertical actuator mounted to the front rail of the main frame for selectively pushing the front end of the pallet upwards. A vertical stop may be fixedly disposed on the front rail of the main frame and project horizontally over the front end of the pallet, whereby actuation of the vertical actuator causes the front end of the pallet to contact the vertical stop, thereby limiting the vertical displacement of the front end of the pallet. The vertical stop may comprise a downwardly pointing V-shaped member disposed in the y-direction symmetrically over the desired print location, and the pallet may thus further comprise a V-shaped notch adapted to receive the V-shaped member.

The front rail may include a raised portion disposed at the desired print location for contacting the underside of the front end of the pallet, wherein the front end of the pallet is raised upon approaching the desired print location and then lowered as the pallet indexes past the apex of the raised portion.

The y-theta positioning means preferably comprises: frame receiving means fixedly disposed on the carriage for releasably registering the screen therewithin; clamping means for releasably locking the screen with respect to the frame receiving means; and biasing means for urging the screen into leftward register within the frame receiving means. The biasing means may be a controlled actuator which pushes the screen with respect to the frame receiving means. In a particular embodiment, the controlled actuator or actuators are activated to push the screen into registry (i.e. macroregistry) simultaneous with activation of clamps to clamp down on the screen.

The biasing means may be a spring clip disposed on the right side of the frame receiving means, wherein the spring clip pushes leftward against the right side of the screen.

The left side of the frame receiving means further preferably includes a fixed bracket, located forwardly of the spring clip, wherein insertion of the screen into the frame receiving means causes the screen to contact the fixed bracket, wherein the fixed bracket directs the screen rightwardly into contact with the spring clip as the screen is inserted, and wherein full insertion of the screen toward the rear of the frame receiving means causes the right side of the screen to engage the spring clip, the right end of the rear of the screen to abut the right end of the rear of the frame receiving means, the left end of the rear of the screen to abut the left end of the rear of the frame receiving means, and the left side of the screen to engage the fixed bracket. Thus, the user may insert a screen and solidly register the screen within the frame receiving means.

The fixed bracket may include a side portion for abutting the rear of the left side of the screen and a rear portion for abutting the rear of the screen, whereby the screen registers against the spring clip, the side and rear portions of the fixed bracket, and the right end of the cross-bar. The side portion of the fixed bracket may further include an inwardly extending projection disposed forwardly from the extreme rear end of the screen, whereby the projection provides a point of contact with the left side of the screen which is forwardly offset from the spring clip.

The frame receiving means preferably includes an adjustable screen holder having a left inwardly-facing U-channel member fixedly attached to the carriage, a right inwardly-facing U-channel member fixedly attached to the carriage, and a rear cross-bar movably disposed between the left and right U-channel members, wherein the adjustable screen holder has an open front end for receiving the screen, and wherein the screen abuts the rear cross-bar when fully inserted into the screen holder.

The frame receiving means may include a rear cross-bar fixing means for fixing the orientation of the rear cross-bar between the left and right U-channel members. In a particular embodiment, the rear cross-bar fixing means comprises a spring-biased outwardly projecting fixing pin disposed on one end of the rear cross-bar for contacting one of the U-channel members and pin locking means for selectively unlocking the pin during adjustment of the position of the cross-bar and for selectively locking the pin after positioning of the cross bar is complete, thereby securing the position of the rear cross-bar between the left and right U-channel members.

The y-theta positioning means further preferably comprises: a left actuator fixedly attached to the left rear of the carriage for selectively moving the left end of the rear cross-bar forward and backward in the y-direction; and, a right actuator fixedly attached to the right rear of the carriage for selectively moving the right end of the rear cross-bar forward and backward in the y-direction. Thus, unequal changes in y-displacement of the left and right ends of the cross-bar result in angular displacement of the screen in the theta direction.

The frame-receiving means may further include guide means for contacting the outer periphery of the screen, whereby the guide means facilitates repeatable registration of the screen. In a particular embodiment, the guide means comprises at least one spring-biased inwardly projecting guide pin and pin locking means for selectively locking the pin. Thus, the pin is unlocked during adjustment or microregistration of the screen and the pin is locked after the screen is aligned in proper registry.

The screen printing apparatus may further include rear locator means for releasably securing the rear of the pallet at the desired print location. The rear locator means may include a rear locator actuator disposed on the main frame at the desired print location for selectively applying a generally horizontally directed force against the pallet, thereby temporarily securing the rear of the pallet at the desired print location during printing, the rear locator actuator including a rear locator head, wherein the pallet has a rear locator receiving portion which is provided with an indent adapted to receive the rear locator head. The indent may be a generally V-shaped notch. The rear locator portion may comprise a pair of convex lobes, wherein the notch is disposed at the intersection of the lobes. In a particular embodiment, the rear locator head is a wheeled head for rolling over the surface of the rear of the pallet while the pallet is being indexed.

The printing head assembly may further comprise carriage slide means for allowing controlled movement of the carriage in the x-direction. The carriage slide means may thus include at least one wheel member adapted to roll atop the main frame.

In another aspect, the present invention relates to a method for microregistering a screen within a screen printing apparatus, the screen printing apparatus including at least one pallet, a semi-stationary print head capable of receiving the screen, and a pallet drive means for indexing the pallet, the pallet being indexed, wherein the screen is disposed in a generally horizontal x-y plane, wherein angular displacement of the screen about a substantially vertical axis passing through the x-y plane corresponds to a theta direction. The method comprises: microadjusting the position of the semi-stationary print head in the x-direction and securing the print head at a desired print location; and microadjusting the screen within the print head in at least one of the y-direction and the theta-direction. Thus, microadjustment of the screen relative to the pallet in the x-direction is accomplished independently of microadjustment of the screen in the y-direction and the theta-direction.

In yet another aspect, the present invention relates to a method for microregistering a screen within a printing apparatus, the printing apparatus including at least one pallet for mounting an object to be printed, a semi-stationary print head capable of receiving the screen in a generally horizontal x-y plane, wherein angular displacement of the screen about a substantially vertical axis passing through the x-y plane corresponds to a theta direction. The method comprises: microadjusting the position of the semi-stationary print head in the x-direction and securing the print head at a desired index location; and microadjusting the screen within the print head in at least one of the y-direction and the theta-direction, whereby microadjustment of the screen relative to the pallet in the x-direction is accomplished independently of microadjustment of the screen in the y-direction and the theta-direction.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

FIG. 1 schematically represents a top plan view of a printing head carriage 10 according to the present invention. A screen 12 is mounted on the printing head carriage 10 and is adjustable thereon. The carriage 10 is selectively movable in the x direction, wherein the particular representation of the carriage shown in FIG. 1 includes four wheels 14. Typically, the wheels 14 are locked in position after the carriage 10 is positioned or wheeled to a desired location such as a desired printing location. Thus, the carriage 10 may be moved in the positive or negative x direction, for example by motor drive or by manual drive, and subsequently held in place over a print location or printing station, for example by a braking means or locking means.

The screen 12 is inserted at the front end of the carriage 10 and slid into register with respect to the printing head carriage 10 so as to place the screen 12 into contact with at least four contact points. The first contact point 20 provides a fixed point near the rear of the left side of the screen 12. A second contact point 22 is provided by a spring means which pushes the screen 12 into contact with the fixed point 20. The rear of the screen 12 is contacted by left 30 and right 32 movable contact points. The rear contact points 30,32 are selectively movable in the y-direction.

The movable contact points 30,32 are particularly preferably located near the extreme edges of the rear 24 of the screen 12. That is, the moveable contact points 30,32 should provide support to the frame 12 at points which are widely spaced enough to prevent creation of a pivot point about one of the movable contact points when the other moveable contact point is adjusted. While some offset toward the center of the screen 12 may be tolerated, it is preferable to place the moveable contact points 30,32 as wide as possible, preferably at or near the ends or corners of the screen 12.

For example, as shown in FIG. 2, the right end of the rear of the screen 12 is pushed forward while the left end of the screen 12 remains substantially at a fixed y-location.

FIG. 3, shows an example of a pair of moveable contact points which are situated unsuitably too far away from the extreme ends of the screen 12, wherein displacement of the right end in a positive y-direction causes the left end to travel backward in a negative y-direction, as shown by dashed lines, thereby complicating the adjustment or registration of the screen 12 with compound displacements.

Referring again to FIG. 1, a fifth contact point 34 may be provided at a location corresponding to the front of the carriage 10 so as to provide a guide for insertion of the screen 12. The fifth contact point 34 may be a guide means, such as a floating guide pin or disappearing guide pin which is biased inward to contact the screen 12 and is selectively locked in place when the desired orientation of the screen is attained. Thus, the screen 12 may be removed while the guide pin, or guide pins, are still locked, so that the screen may be reinserted into an already-registered position.

Thus, fine adjustment, or microregistration, of the screen 12 may be effected in the y-direction by controlled movement of the left and/or right rear contact points 30,32. Furthermore, angular displacement of the screen 12 with respect to the carriage may be effected by unequal displacement of the left and right rear contact points 30,32, wherein in-plane rotation of the screen 12, i.e. within the x-y plane, about a vertical axis may be referred to as theta-rotation. Thus, y and theta microregistration of the screen 12 can be accomplished by selective positioning of the left and right rear contact points 30,32.

Furthermore, microregistration of the screen 12 with respect to a pallet positioned beneath the screen may be effected by finely controlled movement of the carriage 10 in the x-direction.

Once the carriage 10 has been moved to a desired x-location corresponding to proper alignment between a given screen 12 and the indexed location, further movement of the carriage is prevented, resulting in a semi-stationary printing head assembly.

In a particularly preferred embodiment, the screen 12 is gripped or clamped at the first and second movable contact points 30,32 to provide control of the movement of the screen 12. Thus, if an adjustment of the screen 12 in a negative y-direction is effected, the screen will be drawn backward with respect to the printing head assembly.

FIG. 4 shows a particular embodiment of part of a printing head carriage 10 according to the present invention. Two of the wheels 14 are visible in FIG. 4. The wheels 14 are rollably mounted on a cylindrical guide rail 40, which is fixably disposed on a rear rail 42 of a mainframe. The mainframe also includes a front rail 44 which supports the front end of the carriage 10. A left inwardly-facing U-channel member 46 is fixably attached to the carriage 10 and may be part of the carriage. A right inwardly-facing U-channel member 48 is also fixably attached to the carriage. A screen frame 12 is shown disposed on top of, and between, the left and right U-channel members 46,48. The screen 12 is centered over a pallet 50 which is attached to an indexing chain 52 by resilient mounts 54. The pallet 50 typically is able to at least slightly pivot about the resilient mounts 54 so that the front end of the pallet 50 may be raised or lowered to some degree. Normally, the pallet 50 is generally horizontally disposed as it is indexed past the printing station. The mainframe may include an intermediate rail 56 for additionally supporting the pallet 50 near its rear. A squeegee/applicator assembly 58 is also shown disposed over the screen, however other portions of the printing head assembly are not shown for the sake of simplicity and for clarity in the drawing. Furthermore, a front bar connecting the left and right U-channel members 46,48, as well as the wheels which are rotatably disposed underneath the front bar and which roll upon the top surface of the front rail of the mainframe, are not shown for purposes of simplification of FIG. 4.

Thus, a printing head assembly 10 is positioned with respect to the mainframe by rolling the carriage along the mainframe to a desired print location and subsequently locked in place. The chain 52 indexes the pallet 50, or typically a plurality of pallets, in the x-direction. A screen 12 is placed into register with respect to the U-channel members 46,48, and microregistration of the screen 12 with respect to the printing head assembly, as accomplished by a y-theta positioning means, is further described hereinbelow. Fine adjustments, or micro-adjusting, of the screen 12 in the x-direction may thus be accomplished by unlocking the wheels 14 of the carriage 10 and controllably rolling the printing head assembly 10 to the left or right in order to achieve proper alignment for purposes of printing. Thus, for a given screen 12, the printing head assembly 10 remains stationary with respect to the mainframe for a printing run.

Typically, the chain 52 is part of a pallet drive means mounted to the mainframe or disposed adjacent to the mainframe for indexing the pallet 50. The chain 52 is preferably an endless chain which indexes the pallet 50 or pallets around a closed loop. Thus, the x-direction is at least locally parallel to the path of the chain 52.

Figure 5:
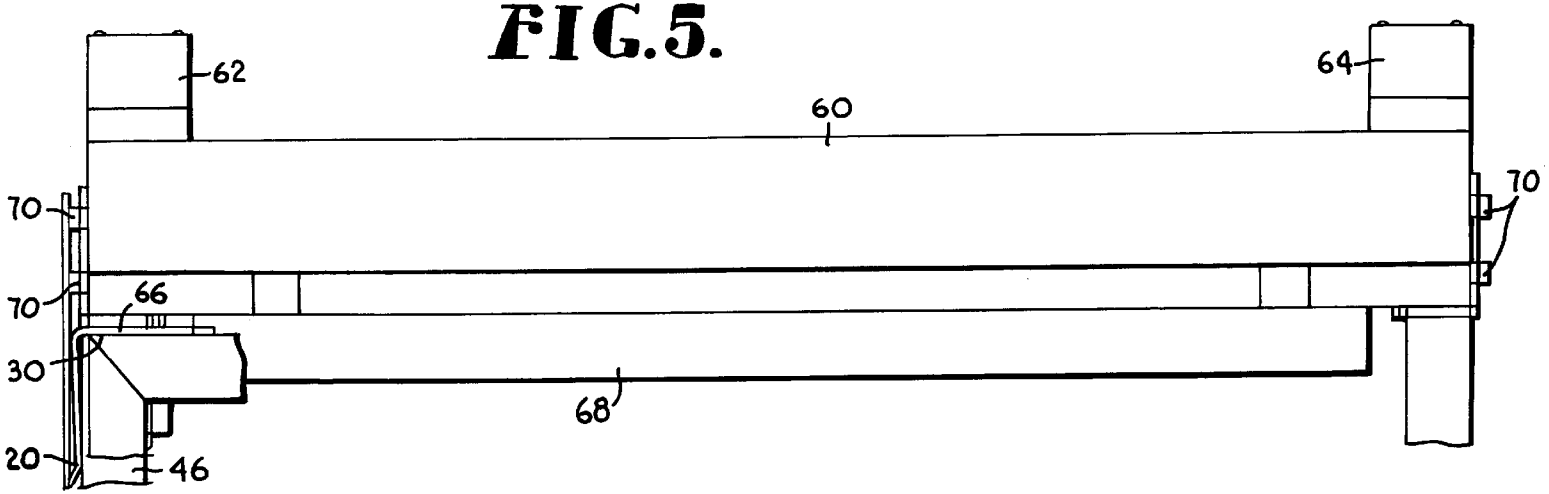
FIG. 5 is a top view of the rear portion of a printing assembly according to the present invention.

FIG. 5 shows a top plan view of the rear of the printing head assembly 10. A portion of the left inwardly-facing U-channel member 46 is shown. A rear cross-bar 60 is disposed between the left and right U-channel members 46,48. The rear cross-bar 60 is adapted to abut the screen 12 when the screen is fully inserted into the printing head assembly 10. A left actuator 62 is fixably attached to the left rear of the carriage 10 for selectively moving the left end of the rear cross-bar 60 forward and backward in the y-direction. A right actuator 64 is fixably attached to the right rear of the carriage 10 for selectively moving the right end of the rear cross-bar 60 forward and backward in the y-direction. A left contact point 30 is provided by a left stop plate 82. Similarly, a right contact point 32 is provided by a right stop plate 82. A lip 68 is provided for additional support of the screen. Spring-biased outwardly projecting fixing pins 70 are disposed on the left and right ends of the rear cross-bar 60 for contacting the respective U-channel members. The left and right actuators 62,64 may be powered or manually operated.

A pin locking means, not shown in FIG. 5, selectively unlocks the fixing pins 70 during adjustment of the positioning of the cross-bar 60 and selectively lock the pins after positioning of the cross-bar 60 is completed, thereby securing the position of the rear cross-bar between the left and right U-channel members 46,48.

FIG. 5 shows the left rear corner of the screen abutting a left rear fixed bracket 66 which provides a left rear contact point 30 and a left side contact point 20. The left side contact point 20 is disposed forwardly from the rear edge of the screen frame. The fixed bracket 66 is provided with an indentation which provides the left side contact 20 so that the fixed bracket 66 is spaced apart from the extreme rear end of the left side of the screen 12.

Figure 6:
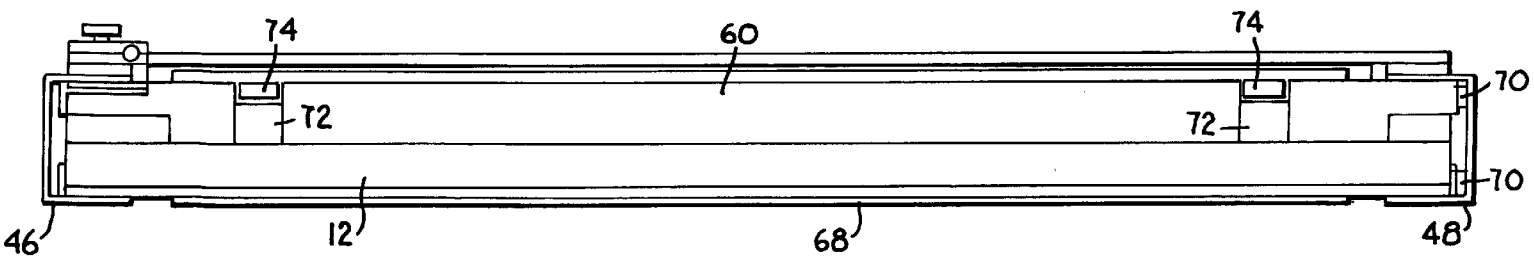
FIG. 6 is a front elevational view of the frame receiving means of FIG. 3 shown with a screen frame inserted therein.

FIG. 6 is a front elevational view of the frame receiving means of FIG. 5, wherein the complete screen 12 is shown disposed between the left and right U-channel members 46,48. The rear cross-bar 60 is provided with left and right recesses 72 adapted to accommodate left and right rear clamps 74 which clamp down on the rear edge of the screen frame after the screen is inserted into the printing head assembly. Only the right side fixing pins 70 are shown in FIG. 6.

Figure 7:
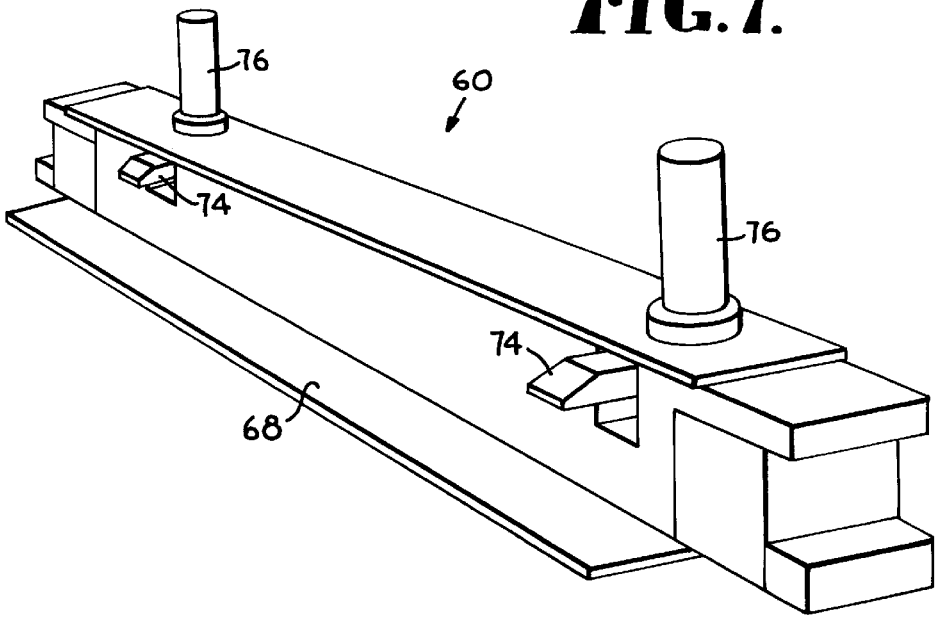
FIG. 7 is an isometric view of a rear cross-bar of a frame receiving means according to the present invention.

FIG. 7 is an isometric view of an embodiment of a rear cross-bar 60 of the frame receiving means of the printing head assembly of the present invention. The left and right clamps 74 are driven by left and right clamp actuators 76. The main body of the rear cross-bar 60 may be made from metal, a durable plastic material, such as HYFAX®, or other suitable rigid material.

Figure 8:
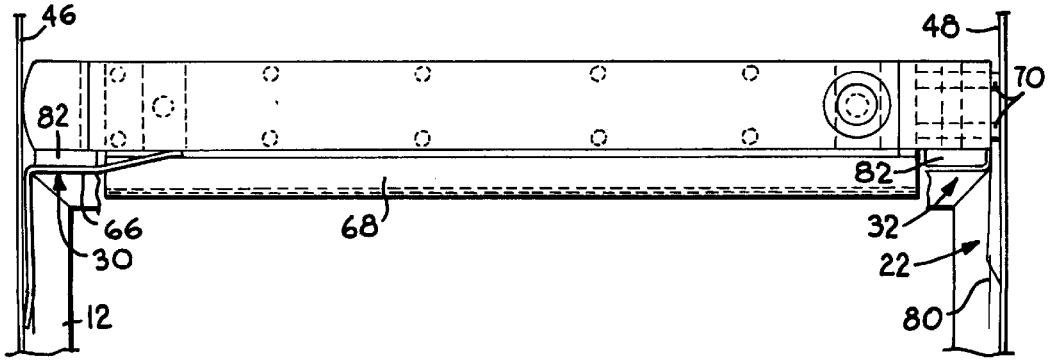
FIG. 8 is a partial top plan view of the rear portion of a frame receiving means according to the present invention showing a screen abutting a right spring, a right rear stop pad, and a left fixed bracket.

FIG. 8 shows the main body of the rear cross-bar 60. In this preferred embodiment, two fixing pins 70 are disposed on the right end of the cross-bar 60 for contacting the right U-channel member 48. The left end of the main body of the cross-bar 60 is convex, wherein the cross-bar may be rolled upon the left U-channel member 46 during slight adjustment of the cross-bar. A left rear fixed bracket 66 engages the left rear of the screen 12, while the rear of the right side of the screen is urged toward the left by the spring member 80. Left and right rear contact points 30,32 are thus set by the left and rear stop plates 82 of the rear cross-bar 60 while the spring 80 provides a contact point 22 on the right side and the fixed bracket 66 provides a contact point 20 on the left side of the screen 12.

Figure 9:
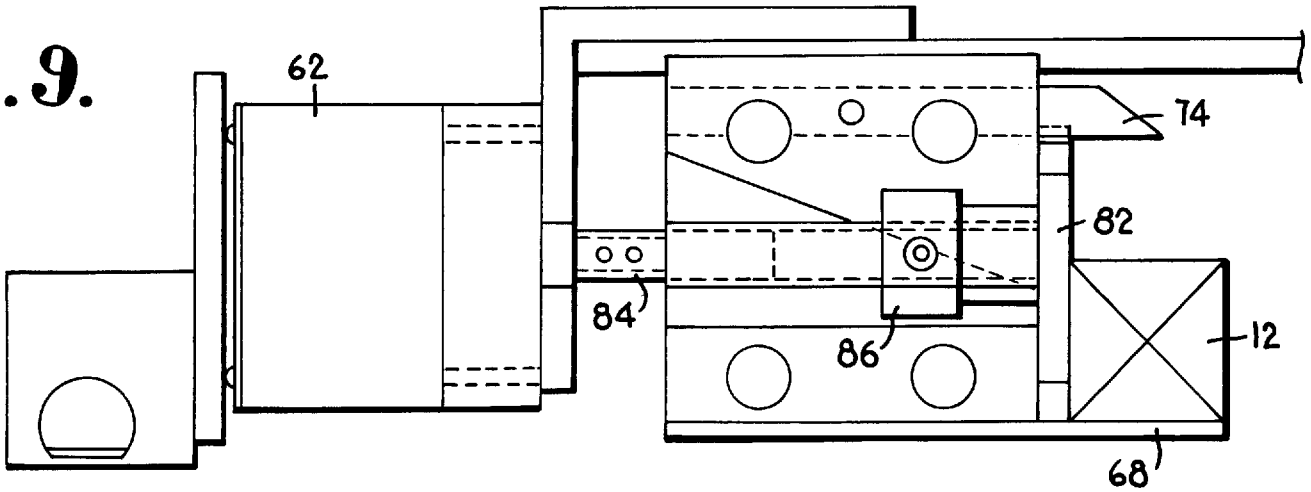
FIG. 9 is a side elevational view of the rear portion of the frame receiving means and part of the y-theta positioning means, according to the present invention.

FIG. 9 shows a side elevational view of the rear portion of the frame receiving means of the printing assembly 10 and part of the y-theta positioning means. The actuator 62 is fixably attached to the printing head carriage. The screen 12 abuts the stop plate 82 and rests upon the lip 68. The clamp 74 is shown in the disengaged position. The actuator for the clamp 74 is not shown in FIG. 9. After the clamps 74 engage the rear cross-bar 60 with the back of the back of the screen, the orientation of the cross-bar is adjusted. The actuator 62 drives a shaft 84 which is threadably connected to a threaded connector 86 fixed within the main body of the rear cross-bar. Thus, rotation of the shaft 84 causes the respective portion of the rear cross-bar to translate in the y-direction, thereby adjusting the rear contact point with the screen. Forward displacement of the cross-bar causes the screen to move forwardly. A rearward displacement of the cross-bar causes the screen to move backwardly because the screen is clamped to the cross-bar.

FIG. 10 is a top plan view of a preferred embodiment of the spring member 80.

FIG. 11 shows a front elevational view of the spring member 80.

FIGS. 12 and 13 show a particularly preferred embodiment of the fixed bracket 66. The fixed bracket 66 comprises a side portion 90 for abutting the rear of the left side of the screen and a rear portion 92 for abutting the rear of the screen. Thus, the screen registers against the spring member of spring clip 80, the side 90 and rear 92 portions of the fixed bracket, and the right end of the cross-bar. The fixed bracket is further provided with a reinforcement member 94.

Figure 14:
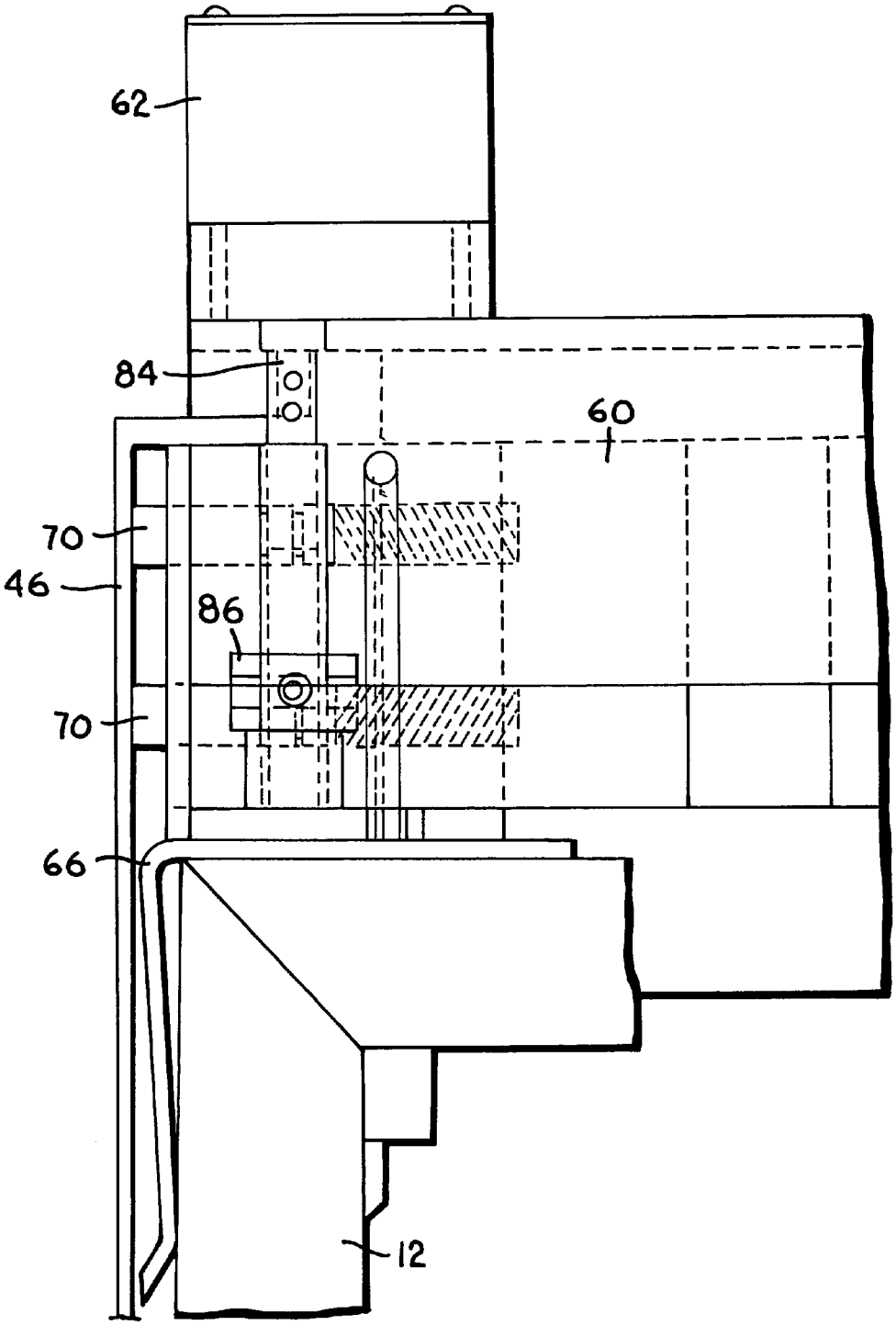
FIG. 14 is a top plan view of FIG. 9.

FIG. 14 shows an alternate embodiment of the present invention wherein the rear cross-bar 60 is provided with two fixing pins 70.

Figure 15:
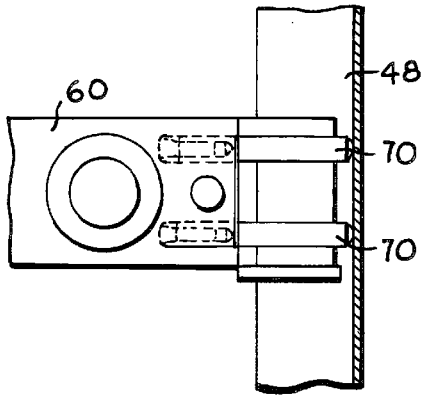
FIG. 15 is a top plan view of a floatable rear cross-bar positioning means according to the present invention.
Figure 16:
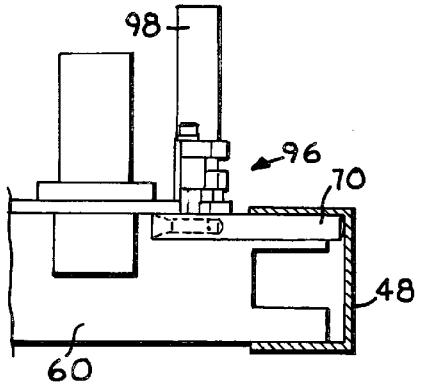
FIG. 16 is a front elevational view of FIG. 15.

FIGS. 15 and 16 illustrate two fixing pins 70 disposed on the right side of the rear cross-bar 60. The fixing pins 70 project outwardly from the cross-bar and are spring-biased in the direction of the right U-channel.

FIG. 16 shows a pin locking means 96 for selectively locking the pins 70 after positioning of the cross-bar 60 is completed. A single actuator 98 pushes downwardly on a transverse bar which simultaneously contacts the two fixing pins 70, thereby securing the pins in position. The fixing pins thus maintain the cross-bar in a fixed relationship with respect to the U-channel member. Alternate configurations or mechanisms for selectively locking the pins may be provided; for example, multiple actuators instead of a single actuator, or actuators mounted horizontally instead of vertically, etc.

The side portion 90 of the fixed bracket 66 includes an inwardly extending projection 100 disposed forwardly from the extreme rear end of the screen, whereby the projection provides a point of contact 20 with the left side of the screen which is forwardly offset from the contact point 22 with the spring clip 80.

Figure 17:
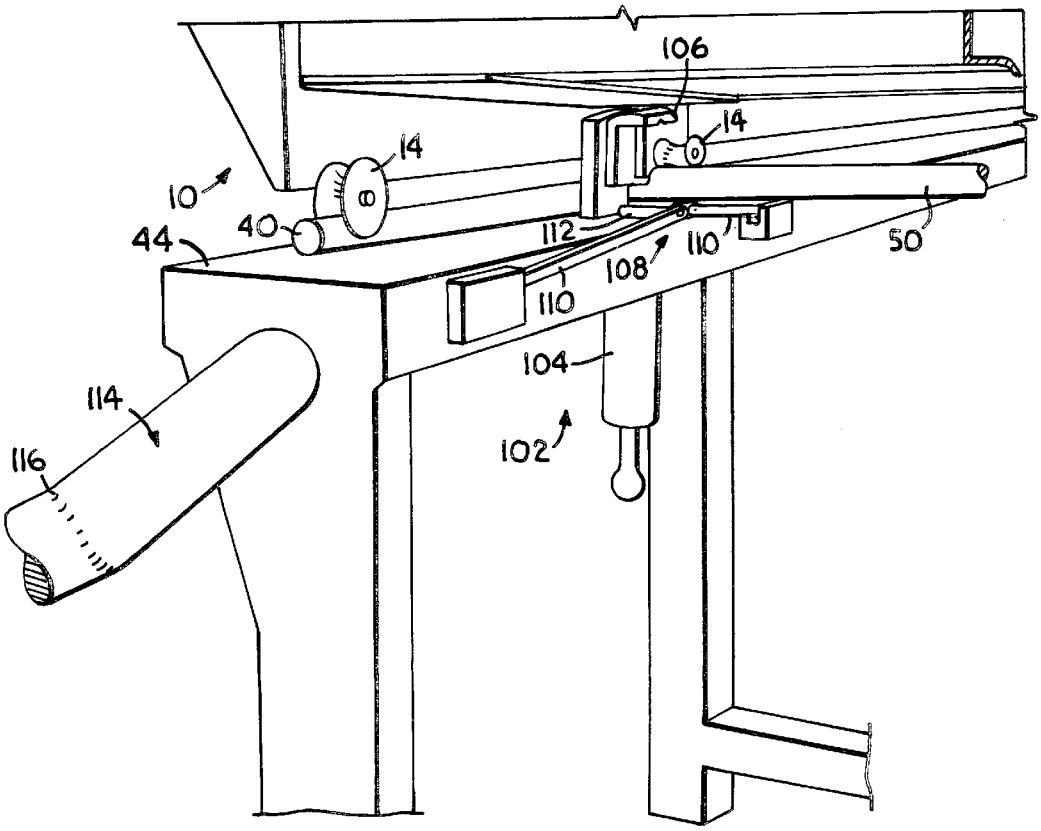
FIG. 17 is an isometric view showing the underside of a printing head assembly movably mounted on a frame, and showing a front pallet locator means according to the present invention.

FIG. 17 illustrates one embodiment of a pallet engaging means 102 for selectively raising the front end of the pallet 50 toward the printing head assembly, and the screen disposed therewithin, during printing. Wheels 14, which are rotatably mounted on the front end of the carriage, are rotatably mounted on a cylindrical rail 40 which is fixably attached to the front rail 44 of the mainframe. The pallet engaging means 102 includes a vertical actuator mounted to the front rail of the mainframe for selectively pushing the front end of the pallet upwards. A vertical stop 106 is fixably disposed on the front rail of the mainframe and projects horizontally over the front end of the pallet. The vertical stop includes a downwardly pointing V-shaped member disposed in the y-direction symmetrically over the desired print location. The pallet includes a V-shaped notch matingly adapted to receive the V-shaped member, or vice-versa. Thus, actuation of the vertical actuator causes the front end of the pallet to contact the vertical stop, thereby limiting the vertical displacement of the front end of the pallet. Furthermore, registration of the front end of the pallet in the x-direction is also fixed.

The front rail is also provided with a raised portion 108, disposed at the desired print location for contacting the underside of the front end of the pallet. The front end of the pallet is raised upon approaching the desired print location and then lowered as the pallet is indexed past the apex of the raised portion. The raised portion in FIG. 17 is comprised of two inclined rails 110 attached to a raised platform 112.

The raised portion 108 thus optionally provides a partial vertical displacement of the front end of the pallet when the pallet is in the locus of a desired print location. However, the vertical displacement of the front end of the pallet may be accomplished solely by a vertical actuator 104.

Furthermore, the printing head assembly may be movably disposed on the mainframe by other means. For example, the wheel members of the carriage may, instead of having a concave groove which is adapted to roll upon a cylindrical rail, take the form of a solid roller or wheel or track for rolling atop a flat surface, such as the front rail of the mainframe.

FIG. 17 also shows a cylindrical portion 114 of the mainframe having a downwardly inclined section 116 and a level section to provide a loading station which gives the user the ability to insert an article, for example an article of clothing, over or on top of the pallet as the pallet is indexed to the loading station.

Figure 18:
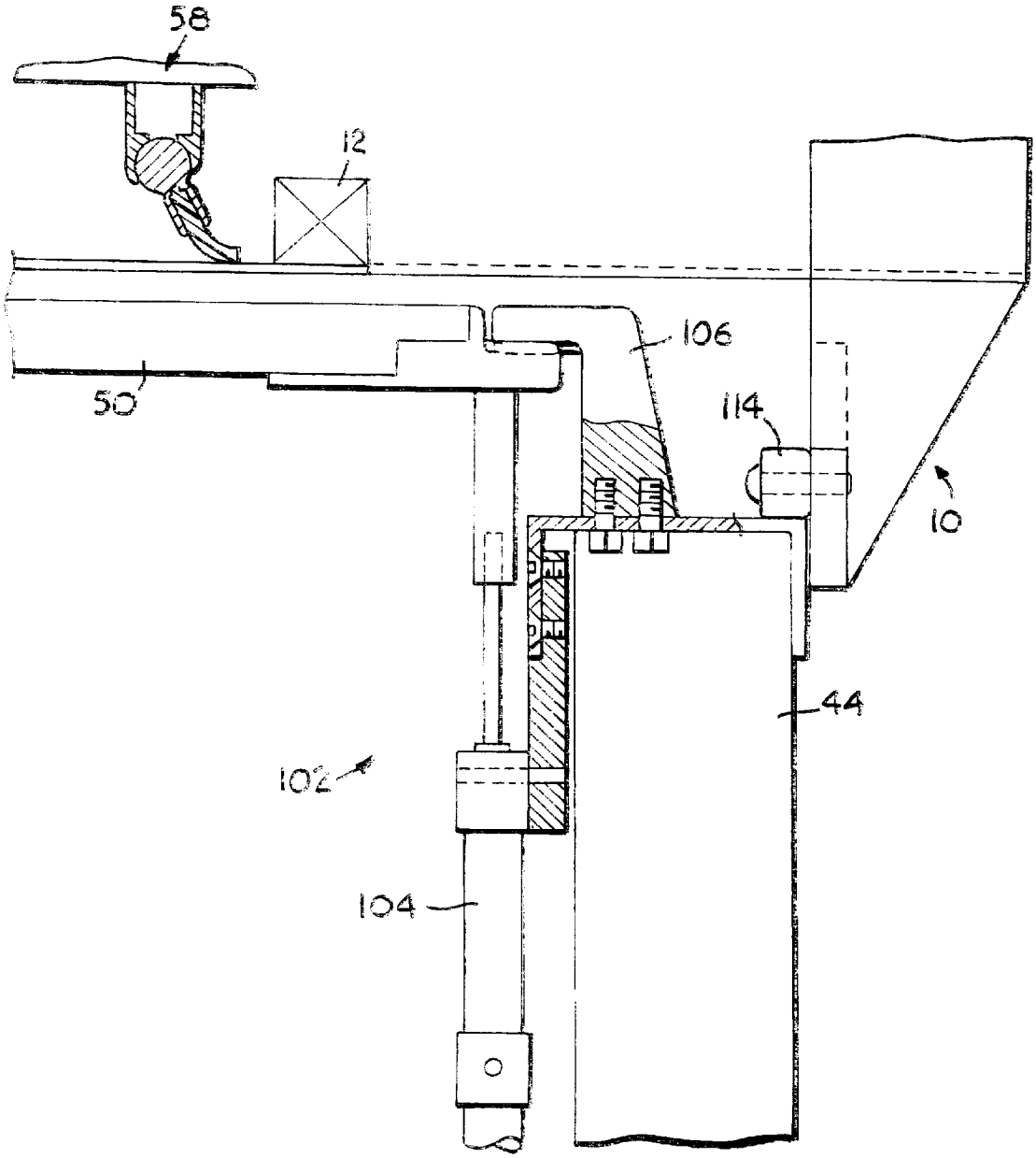
FIG. 18 is a side elevational view of a front pallet locator means according to the invention, showing a vertical actuator pushing the front end of the pallet against a vertical stop during printing.

FIG. 18 is another illustration of an embodiment of a front pallet locator means 102 according to the present invention. The vertical actuator 104 is shown in its distended position, thereby engaging the front end of the pallet against the vertical stop.

Figure 19:
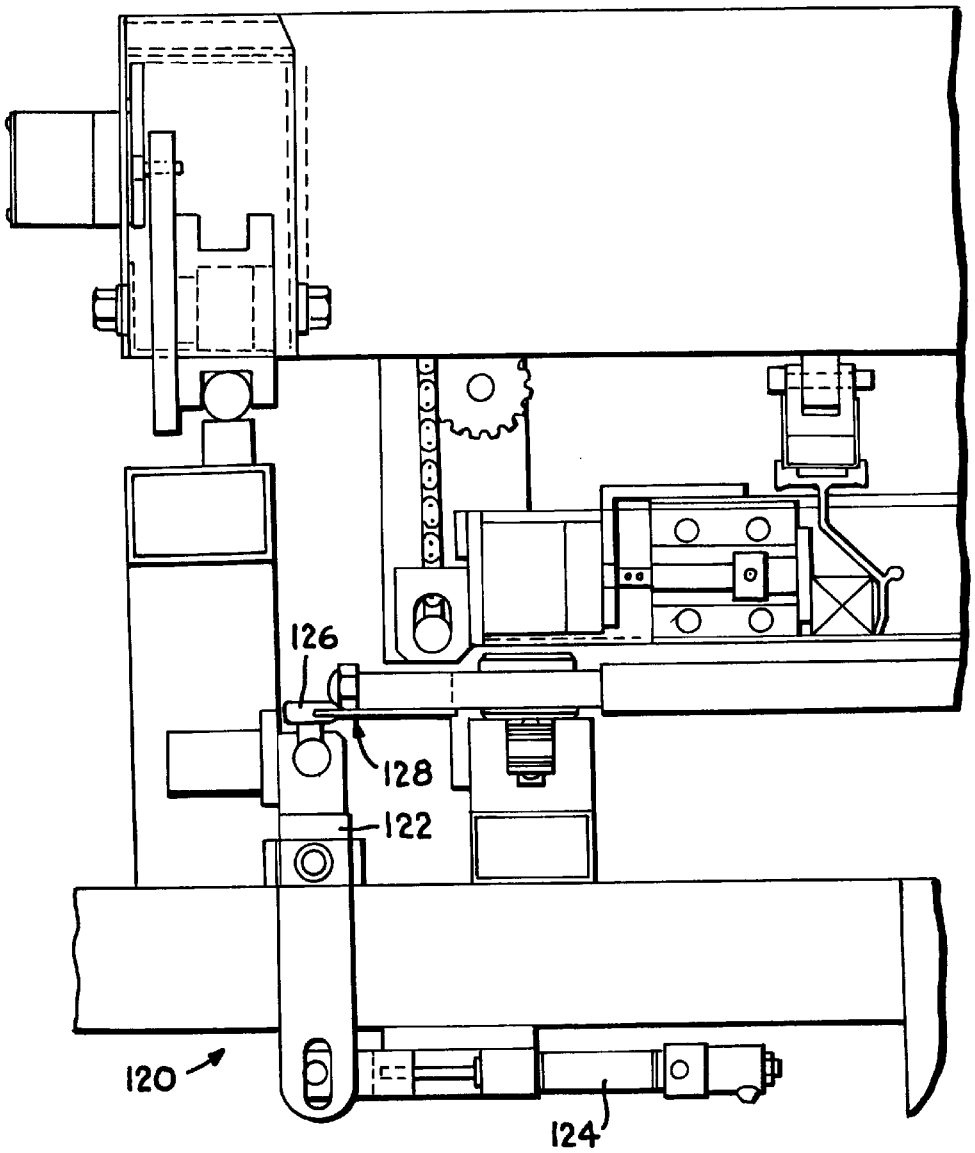
FIG. 19 is a side elevational view of the rear portion of a printing head assembly according to the present invention, showing a rear locator means and the rear portion of the printing head carriage movably mounted on a rail.

FIG. 19 shows a rear locator means 120 for releasably securing the rear of the pallet head at a desired print location. The rear locator means 120 comprises a rear locator actuator 122 disposed on the mainframe at the desired print location and driven by a rear locator driver 124 for selectively applying a generally horizontally directed force against the rear end of the pallet, thereby temporarily securing the rear of the pallet at the desired print location during printing. The rear locator actuator 122 includes a rear locator head 126. The pallet has a rear locator receiving portion 128 which is provided with an indent adapted to receive the rear locator head of the rear locator actuator. The rear locator driver may be unconnected to or untethered with the rear locator actuator arm, as shown in FIG. 19. Thus, when a desired print location is reached by indexing the pallet, the driver pushes against the bottom end of the actuator, which pivots to allow the locator head to contact and exert pressure against the rear of the pallet head. Other arrangements are possible, such as mounting the driver to directly engage the top of the locator arm and to exert a horizontally directed force toward the rear of the pallet. Preferably, the indexing action, along with the compatible design of the rear of the pallet and the rear locator, allow the moving pallet to slide past the locator head and force the head outward while either no pressure or a reduced pressure is applied by the rear locator driver.

Figure 20:
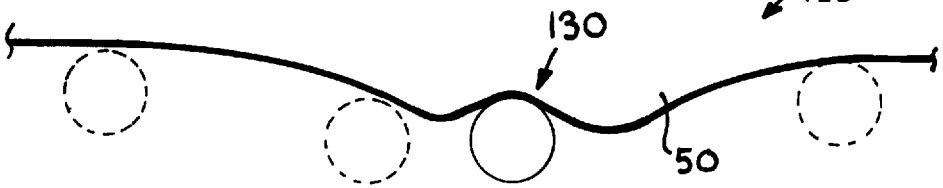
FIG. 20 is a top plan view of a particular embodiment of a rear locator portion of a pallet being engaged by the head of a rear locator actuator.

FIG. 20 shows the rear portion of a pallet which is provided with an indent 130 having the form of a generally V-shaped notch. The rear locator portion is comprised of a pair of convex lobes, wherein the notch is disposed at the intersection of the lobes. In a particularly preferred embodiment, the rear locator head is a wheeled head for rolling over the surface of the rear of the pallet while the pallet is being indexed. Thus, shock to the pallet and/or the chain drive means, and/or the resilient mounts, as would be commonly found in currently existing devices, is avoided with the present invention.

Furthermore, a fixed transverse stop may be disposed on the bottom surface of the pallet and situated slightly rearwardly of the intermediate rail, for use with apparatuses which include an intermediate rail. Thus, when the rear locator engages the pallet, the pallet experiences a forward directed force. The traverse stop limits the travel of the pallet in a forward direction and absorbs any excess force generated by the rear locator actuator.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A screen printing apparatus for use with at least one framed screen, said apparatus comprising:

a main frame including a front rail and a rear rail;

a pallet drive assembly including at least one pallet, and a pallet drive means mounted to said main frame for indexing said pallet, said pallet being indexed in an x-direction while remaining generally in a horizontal orientation; and at least one printing head assembly mounted on said main frame, wherein said printing head assembly is selectively moveable in the x-direction, said printing head assembly including:

a carriage adjustably positionable atop said front and rear rails of said main frame; and y-theta positioning means mounted to said carriage for abutting said screen in a generally horizontal x-y plane and for selectively adjusting the orientation of said screen in at least one of a linear displacement in the y-direction and an angular displacement in a theta-direction about a substantially vertical axis passing through said x-y plane, wherein said y-theta positioning means comprises:

frame receiving means fixedly disposed on said carriage for releasably registering said screen therewithin;

clamping means for releasably locking said screen with respect to said frame receiving means; and biasing means for urging said screen into leftward register within said frame receiving means, wherein said pallet drive means indexes said pallet to said printing head assembly at a desired print location;

whereby the linear position of said screen relative to said pallet in the x-direction is adjustable by moving said carriage relative to said main frame in the x-direction;

whereby changes in both the linear orientation of said screen in the y-direction and the angular orientation of said screen in the theta-direction, relative to said pallet, are effected by moving said screen relative to said carriage; and whereby adjustment of said screen relative to said pallet in the x-direction is accomplished independently of adjustment of said screen in both the y-direction and the theta-direction.

2. The screen printing apparatus according to claim 1 wherein said biasing means comprises a spring clip, said spring clip disposed between a right side of said screen and said frame receiving means.

3. The screen printing apparatus according to claim 2 wherein a left side of said frame receiving means further comprises a fixed bracket, located forwardly of said spring clip, wherein insertion of said screen into said frame receiving means causes said screen to contact said fixed bracket, wherein said fixed bracket directs said screen rightwardly into contact with said spring clip as the screen is inserted, wherein fill insertion of said screen toward a rear of said frame receiving means causes the right side of said screen to engage said spring clip, a right end of a rear of said screen to abut a right end of the rear of said frame receiving means, a left end of the rear of said screen to abut a left end of the rear of said frame receiving means, and a left side of said screen to engage said fixed bracket.

4. The screen printing apparatus according to claim 3 wherein said fixed bracket further comprises:

a side portion for abutting the rear of the left side of said screen; and a rear portion for abutting the rear of said screen;

whereby said screen registers against said spring clip, said side and rear portions of said fixed bracket, and said right end of the rear of said frame receiving means.

5. The screen printing apparatus according to claim 4 wherein said side portion of said fixed bracket further comprises an inwardly extending projection disposed forwardly from a extreme rear end of said screen, whereby said projection provides a point of contact with the left side of said screen which is forwardly offset from said spring clip.

6. The screen printing apparatus according to claim 1 wherein said frame receiving means includes an adjustable screen holder having:

a left inwardly-facing U-channel member fixedly attached to said carriage;

a right inwardly-facing U-channel member fixedly attached to said carriage; and a rear cross-bar movably disposed between said left and right U-channel members;

wherein said adjustable screen holder has an open front end for receiving said screen; and wherein said screen abuts said rear cross-bar when fully inserted into said screen holder.

7. The screen printing apparatus according to claim 6 wherein said frame receiving means further comprises a rear cross-bar fixing means for fixing the orientation of said rear cross-bar between said left and right U-channel members.

8. The screen printing apparatus according to claim 7 wherein said rear cross-bar fixing means comprises:

a spring-biased outwardly projecting fixing pin disposed on one end of said rear cross-bar for contacting one of said U-channel members; and pin locking means for selectively unlocking said pin during adjustment of the position of said cross-bar and for selectively locking said pin after positioning of said cross bar is complete, thereby securing the position of said rear cross-bar between said left and right U-channel members.

9. The screen printing apparatus according to claim 6 wherein said y-theta positioning means further comprises:

a left actuator fixedly attached to a left rear of said carriage for selectively moving a left end of said rear cross-bar forward and backward in the y-direction;

a right actuator fixedly attached to a right rear of said carriage for selectively moving a right end of said rear cross-bar forward and backward in the y-direction;

whereby unequal changes in y-displacement of the left and right ends of said cross-bar result in angular displacement of said screen in the theta direction.

10. The screen printing apparatus according to claim 6 wherein said frame-receiving means further comprises guide means for contacting an outer periphery of said screen, whereby said guide means facilitates repeatable registration of said screen.

11. The screen printing apparatus according to claim 10 wherein said guide means comprises:

at least one spring-biased inwardly projecting guide pin; and pin locking means for selectively locking said pin;

wherein said pin is unlocked during adjustment of said screen; and wherein said pin is locked after said screen is aligned in proper registry.

12. The screen printing apparatus according to claim 1 further comprising rear locator means for releasably securing a rear of said pallet at the desired print location.

13. The screen printing apparatus according to claim 12 wherein said rear locator means comprises:

a rear locator actuator disposed on said main frame at the desired print location for selectively applying a generally horizontally directed force against said pallet, thereby temporarily securing the rear of said pallet at the desired print location during printing, said rear locator actuator including a rear locator head;

wherein said pallet has a rear locator receiving portion which is provided with an indent adapted to receive said rear locator head.

14. The screen printing apparatus according to claim 13 wherein said indent is a generally V-shaped notch.

15. The screen printing apparatus according to claim 14 wherein said rear locator portion comprises a pair of convex lobes, wherein said notch is disposed at the intersection of said lobes.

16. The screen printing apparatus according to claim 13 wherein said rear locator head is a wheeled head for rolling over the surface of a rear of said pallet while said pallet is being indexed.

17. A screen printing apparatus for use with at least one framed screen, said apparatus comprising:

a main frame including a front rail and a rear rail;

a pallet drive assembly including at least one pallet, and a pallet drive means mounted to said main frame for indexing said pallet, said pallet being indexed in an x-direction while remaining generally in a horizontal orientation;

at least one printing head assembly mounted on said main frame, wherein said printing head assembly is selectively moveable in the x-direction, said printing head assembly including:

a carriage adjustably positionable atop said front and rear rails of said main frame; and y-theta positioning means mounted to said carriage for abutting said screen in a generally horizontal x-y plane and for selectively adjusting the orientation of said screen in at least one of a linear displacement in the v-direction and an angular displacement in a theta-direction about a substantially vertical axis passing through said x-y plane; and a pallet engaging means for selectively raising a front end of said pallet toward said screen in said printing head assembly during printing;

wherein said pallet drive means indexes said pallet to said Printing head assembly at a desired print location;

whereby the linear position of said screen relative to said pallet in the x-direction is adjustable by moving said carriage relative to said main frame in the x-direction;

whereby changes in both the linear orientation of said screen in the v-direction and the angular orientation of said screen in the theta-direction relative to said pallet, are affected by moving said screen relative to said carriage; and whereby adjustment of said screen relative to said pallet in the x-direction is accomplished independently of adjustment of said screen in both the v-direction and the theta-direction wherein said front rail includes a raised portion disposed at said desired print location for contacting the underside of the front end of said pallet, wherein the front end of said pallet is raised upon approaching the desired print location and then lowered as said pallet indexes past the apex of said raised portion.

18. A registration means for microregistering a screen which is disposed in a generally horizontal x-y plane within a printing device, the printing device having at least one pallet for mounting an object to be printed, said means including:

a print head assembly which, in a first instance, is movable in an x-direction and which, in a second instance, is stationary at a desired print location, said print head assembly including:

screen receiving means for receiving said screen in said x-y plane, wherein angular displacement of said screen in a theta direction corresponds to rotation about a substantially vertical axis passing through said x-y plane; and screen adjustment means for adjusting the orientation of said screen within said x-y plane in at least one of linear displacement in the y-direction and angular displacement in the theta-direction;

whereby adjustment of said screen relative to said pallet in the x-direction at the desired print location is accomplished independently of adjustment of said screen in both the y-direction and the theta-direction;

said screen adjustment means further comprises guide means for contacting the outer periphery of said screen, whereby said guide means facilitates repeatable registration of said screen;

said guide means comprises:

at least one biased inwardly projecting guide pin; and pin locking means for selectively locking said pin;

wherein said pin is unlocked during adjustment of said screen; and wherein said pin is locked after said screen is aligned in proper registry.

19. A screen printing apparatus comprising:

a frame including at least one print station;

a carriage supported on the frame for translational movement relative to the print station in a first direction, and including a pair of elongated screen support members that are spaced from one another in the first direction and extend in a direction generally perpendicular to the first direction; and a screen positioning assembly including a cross bar supported on the carriage for movement along the screen support members, the cross bar including first and second contact points spaced from one another in the first direction, first and second actuators secured between the carriage and the cross bar for shifting the cross bar to adjust the positions of the contact points substantially independently of one another in a second direction perpendicular to the first direction to adjust the position of the screen in the second direction and in a rotational direction that lies in the plane defined by the first and second directions, and at least one screen clamp adapted to engage a screen that is positioned on the carriage against the contact points so that the screen moves with the cross bar.

20. The printing apparatus as recited in claim 19, further comprising at least one pallet supported on the frame for movement in the first direction for positioning a substrate at the at least one print station.

21. The printing apparatus as recited in claim 19, wherein the frame includes a pair of rails extending in the first direction, the carriage being supported on the rails for movement relative to the print station.

22. The printing apparatus as recited in claim 19, wherein the screen positioning assembly includes at least one pin supported on the cross bar and being shiftable between a retracted position in which the cross bar is free to move relative to the carriage and an extended position in which the cross bar is locked against movement relative to the carriage.

23. The printing apparatus as recited in claim 19, wherein the screen positioning assembly is adapted to receive a generally rectangular screen presenting two pairs of generally parallel edges, and includes third and fourth contact points spaced from one another in the first direction and spaced from the first and second contact points in the second direction, the third and fourth contact points being adapted to engage the screen along edges adjacent to an edge engaged by the first and second contact points.

24. The printing apparatus as recited in claim 23, wherein the third and fourth contact points are shiftable relative to one another in the first direction to engage a screen positioned on the assembly.

* * * * *